US006766750B2

(12) United States Patent
O'Connor

(10) Patent No.: US 6,766,750 B2
(45) Date of Patent: Jul. 27, 2004

(54) TRAILER-MOUNTED TRENCH BURNER

(75) Inventor: Brian M. O'Connor, Palm City, FL (US)

(73) Assignee: Air Burners LLC, Palm City, FL (US)

( * ) Notice: Subject to any disclaimer, the term of this patent is extended or adjusted under 35 U.S.C. 154(b) by 0 days.

(21) Appl. No.: 10/254,988

(22) Filed: Sep. 25, 2002

(65) Prior Publication Data

US 2004/0055516 A1 Mar. 25, 2004

(51) Int. Cl.[7] ..... F23B 3/00
(52) U.S. Cl. ..... 110/241; 126/271.3
(58) Field of Search ..... 110/239, 240, 110/241, 341; 126/271.3

(56) References Cited

U.S. PATENT DOCUMENTS

| | | | | | |
|---|---|---|---|---|---|
| 822,839 | A | * | 6/1906 | Fry | 110/239 |
| 1,231,535 | A | * | 6/1917 | Jones | 110/239 |
| 1,597,713 | A | * | 8/1926 | Bishop | 431/243 |
| 3,472,454 | A | * | 10/1969 | Blue et al. | 239/77 |
| 3,682,115 | A | | 8/1972 | Rodgers | |
| 3,699,904 | A | | 10/1972 | Brown et al. | |
| 3,785,302 | A | | 1/1974 | Davis | |
| 3,785,303 | A | | 1/1974 | Hopkins | |
| 3,808,985 | A | | 5/1974 | Raber | |
| 3,869,994 | A | | 3/1975 | Von Berlichingen | |
| 3,945,370 | A | * | 3/1976 | Essington | 126/271.3 |
| 4,000,705 | A | | 1/1977 | Raber | |
| 4,241,671 | A | | 12/1980 | Joyner et al. | |
| 4,688,494 | A | | 8/1987 | Domnitch | |
| 4,739,712 | A | | 4/1988 | McPherson | |
| 4,756,258 | A | | 7/1988 | Gilbert | |
| 4,771,709 | A | | 9/1988 | Applegate | |
| 4,834,002 | A | | 5/1989 | LaChance | |
| 4,889,061 | A | | 12/1989 | McPherson et al. | |
| 4,898,106 | A | | 2/1990 | Bellew et al. | |
| 5,020,452 | A | | 6/1991 | Rybak | |
| 5,050,509 | A | | 9/1991 | Mormino | |
| 5,152,233 | A | | 10/1992 | Spisak | |
| 5,237,938 | A | | 8/1993 | Fujimori et al. | |
| 5,325,795 | A | | 7/1994 | Nelson et al. | |
| 5,415,113 | A | | 5/1995 | Wheeler et al. | |
| 5,626,087 | A | * | 5/1997 | Lompa | 110/196 |
| 5,699,745 | A | | 12/1997 | Kaehr | |
| 5,727,481 | A | | 3/1998 | Voorhees et al. | |
| 5,799,597 | A | | 9/1998 | Kaehr | |
| 6,352,040 | B1 | | 3/2002 | Voorhees et al. | |

FOREIGN PATENT DOCUMENTS

| | | |
|---|---|---|
| WO | WO 92/20965 | 11/1992 |

* cited by examiner

*Primary Examiner*—Kenneth B Rinehart
(74) *Attorney, Agent, or Firm*—Hodgson Russ LLP

(57) ABSTRACT

A trailer-mounted trench burner apparatus comprises a blower source, a carrier pipe supported by roller assemblies on the trailer for movement between a rearward extended position in flow communication with the blower source and a forward retracted position on the trailer, and left and right manifolds pivotally mounted to a rear end of the carrier pipe. The manifolds fold to a storage position extending alongside the carrier pipe and unfold to a usage position extending laterally in opposite direction from the carrier pipe. The manifolds include nozzles for discharging air along an edge of an incineration trench to form an air curtain over the trench and circulate air within the trench. The trailer-mounted trench burner apparatus is designed for fast set-up at, and fast removal from, an incineration site.

14 Claims, 4 Drawing Sheets

TRAILER-MOUNTED TRENCH BURNER

FIELD OF INVENTION

The present invention is directed to the disposal of waste and more particularly to a transportable manifold apparatus for generating a curtain of high-velocity air over and into a waste combustion trench or chamber.

BACKGROUND OF THE INVENTION

The disposal of waste such as trees, brush, yard waste, etc. is a major concern of the municipal, commercial and private sectors. Various types of recycling equipment and techniques are in use or have been proposed to dispose of such waste, all with varying degrees of success.

One method is to transport the waste to a landfill and bury the waste. However, landfill sites are becoming scarce and those remaining are cost prohibitive especially in rapidly growing urban areas. In addition, even if suitable sites can be found, they are often at a distance that makes transportation costs prohibitive. Since vegetation waste makes up approximately 40% of the bulk typically buried in landfills, most large cities require that the waste be separated from conventional garbage for purposes of mulch and compost manufacture in an effort to recycle the waste.

Each year there are tens of thousands of acres of land cleared of trees, brush, etc. for development and millions of tons of yard waste (small branches, leaves, grass, etc.) produced. Reducing the amount of such waste being buried or mulched would significantly reduce the pressure on the existing landfills and delay the need for opening new landfill sites. In addition, landfills are a relatively inefficient method of recycling. Being simply buried at one site, the economic potential of the waste material is never fulfilled. Also, solid waste landfills are diminishing rapidly and permits for new sites are difficult to secure.

Another waste material that presents challenges with regard to disposal is animal carcasses. In the past, diseased animal carcasses were usually buried and forgotten. Little was known about the agents that caused the deadly diseases which have wiped out many herds of cattle and entire chicken farms. It has been discovered that certain pathogens can survive for over fifty years in the soil where they have been buried along with animal carcasses that perished from the disease.

One alternative to landfills has been to incinerate the waste material. With regard to wood and vegetation wastes, this produces an ash residue which is extremely high in natural nutrients beneficial for plant growth. When the ash is mixed with compost and varying amounts of soil, a range of products from high-grade potting soil to top soil are developed. Open burning of the vegetation waste on site is the simplest and most cost effective way of incinerating the waste material. However, due to the many environmental limitations imposed by federal, state, and local jurisdictions, open burning is not always feasible or possible. With regard to the disposal of animal carcasses, the only known practical approach to the elimination of diseased carcasses is high temperature incineration.

Some open pit incineration has been made possible through the use of air curtain incinerators such as the device disclosed in U.S. Pat. No. 4,756,258. In an open pit incinerator, the waste is loaded into a fire pit or trench through an opening and then ignited. High velocity air from a manifold positioned along the opening is then blown over and into the trench. The air flow pattern is intended to over-oxygenate the fire for more complete combustion and to provide a rotating mass of air that acts as a barrier or curtain to reduce the emission of smoke and ash from the fire. At many landfill sites, incineration trenches are dug at various locations on the site to reduce the amount of waste to be buried. It is also commonplace to dig and use incineration trenches at land clearing sites to reduce waste and generate soil nutrients, at forest service operation sites to reduce fuel for forest fires and clean post-fire debris, at wood products manufacturing sites to reduce waste, and at disaster sites to facilitate clean-up from a storm or flood or dispose of diseased animal carcasses.

Because road and highway transport of waste materials is costly, and in the case of diseased animals is undesirable for many reasons, the capability to provide an on-site incineration trench and means for generating an air curtain at the trench is beneficial. The aforementioned device of U.S. Pat. No. 4,756,258 provides a transportable trench burner comprising a trailer subassembly 10 carrying a blower source and a manifold subassembly 20 which can be assembled in the form of a T-shaped conduit extending from the blower source. The manifold subassembly is in individual pieces that must be fully disassembled from each other and stored on the trailer subassembly for transport. U.S. Pat. No. 4,739,712 discloses a generally similar trailer-mounted trench burner wherein an air curtain nozzle 1 must be disconnected from an air supply conduit 2 and stored atop the air supply conduit for transport. These trailer-mounted trench burners of the prior art are time consuming to assemble and disassemble, and require considerable trailer space to carry the disassembled parts. Moreover, hardware for securing the assembly connections is susceptible to being lost and must then be replaced.

U.S. Pat. No. 5,415,113, which is assigned to the assignee of the present invention, discloses a portable incineration apparatus that provides an air curtain for reducing the emission of smoke and ash and to provide for more complete combustion of the waste materials. The apparatus provides a box having four walls with a top opening and a bottom opening. The inside of the walls are lined with a layer of a refractory material to form a combustion chamber. The incinerator also includes a source of high velocity air that is in air transfer communication with a manifold assembly to direct an effective sheet or curtain of high velocity air across the top of the opening and down into the combustion chamber. The panels that make up the side walls of the apparatus weigh up to 1200 pounds each and are constructed of refractory materials rated to withstand temperatures to 2800° F. Thus, U.S. Pat. No. 5,415,113 provides an "all in one" solution that avoids the need for digging a trench. Although useful, this approach adds to the cost and overall size of the apparatus.

BRIEF SUMMARY OF THE INVENTION

Therefore, it is an object of the present invention to provide a relatively compact trailer-mounted trench burner that may be set up for use or compacted for transport and storage very quickly.

It is another object of the present invention to provide a trailer-mounted trench burner that requires minimal tools and hardware to set up or take down.

It is another object of the present invention to provide improved methods of setting up and taking down a trench burner.

In furtherance of these and other objects, a trailer-mounted trench burner apparatus formed in accordance with a preferred embodiment of the present invention generally comprises a trailer; a blower source supported by the trailer for providing high-velocity airflow; and a foldable airflow delivery system extendable from and retractable to the trailer on rollers. The airflow delivery system includes an elongated carrier pipe extending in a lengthwise direction of the trailer and being mounted on the trailer by roller assemblies for movement between a forward retracted position and a rearward extended position, and left and right manifolds pivotally mounted to the carrier pipe for folding movement between a storage position wherein each manifold extends alongside the carrier pipe and a usage position wherein each manifold extends in a lateral direction from the carrier pipe. The carrier pipe includes an entrance port that aligns with the blower source when the carrier pipe is extended, thereby placing the carrier pipe in flow communication with the blower source. Each manifold includes a flow deflector arranged to receive airflow from the carrier pipe when the particular manifold is unfolded out to its usage position and redirect the airflow laterally for discharge through output nozzles spaced along an air curtain axis defined by the manifolds.

The invention also encompasses novel methods for setting up an incineration trench and a trench burner apparatus and for removing a trench burner apparatus from an operating location at an incineration trench. The set up method generally comprises the steps of towing the present trench burner apparatus near to a desired trench location, arranging the airflow delivery system of the apparatus in flow communication with the blower source, unfolding the airflow delivery system to define an air curtain axis, and digging the incineration trench in edgewise adjacency to the air curtain axis. The removal method generally comprises the steps of folding the airflow delivery system, moving the airflow delivery system out of flow communication with the blower source into a retracted position on the trailer, and towing the trench burner apparatus away from the incineration trench.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
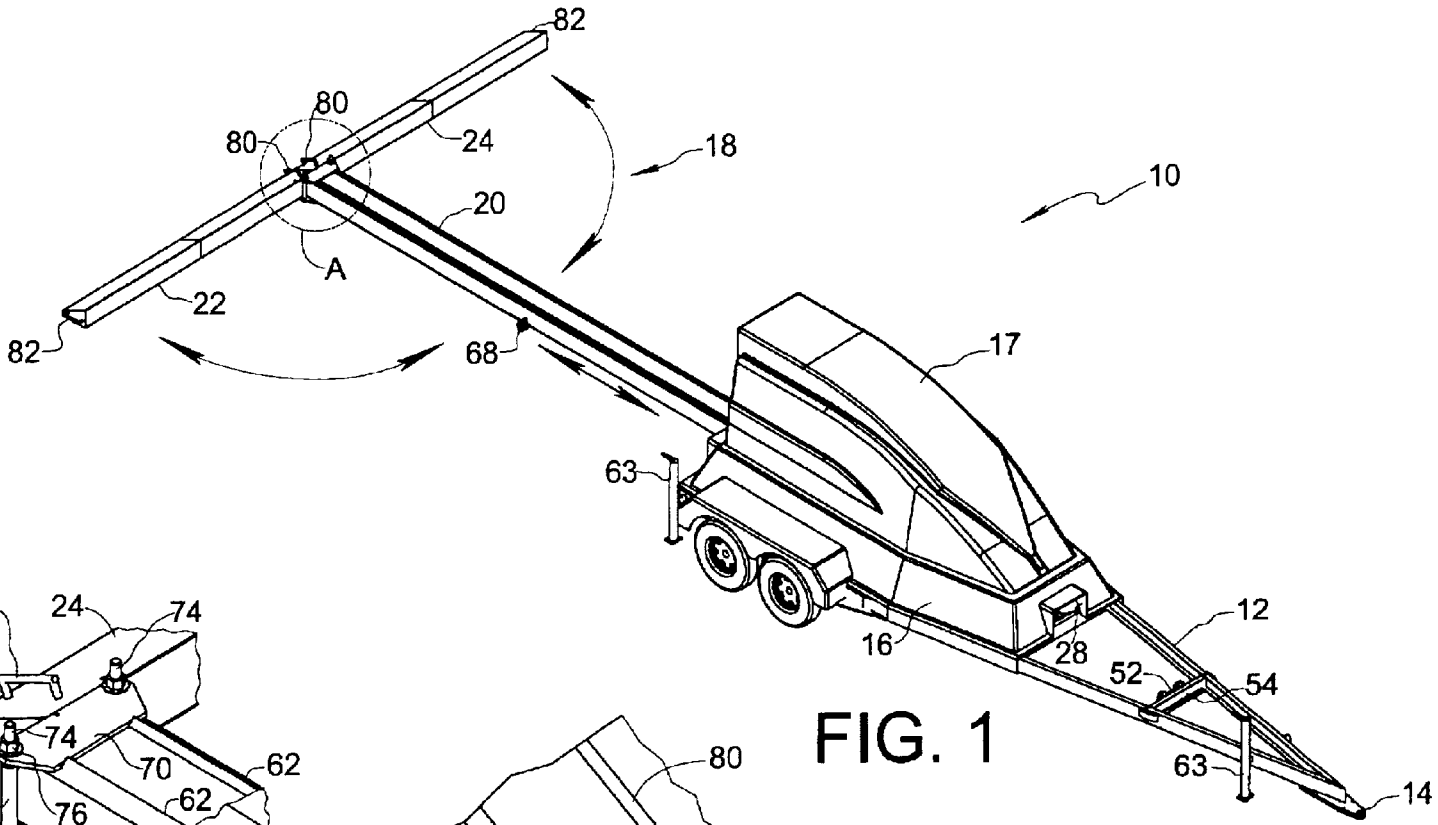
FIG. 1 is a perspective view of a trench burner apparatus of the present invention, shown ready for usage at an incineration trench.

Attention is directed initially to FIG. 1 of the drawings, wherein a trench burner apparatus formed in accordance with a preferred embodiment of the present invention is shown and designated generally by the reference numeral 10. Trench burner apparatus 10 comprises a wheeled trailer 12 having a front end hitch 14 for connecting the trailer to a tow vehicle (not shown), whereby apparatus 10 can be transported to and from combustion trenches in which clean wood waste is incinerated. A lower enclosure 16 and a canopy 17 hingedly connected to lower enclosure 16 cover a rear portion of trailer 12 where operating machinery and equipment of apparatus 10 are housed. Trench burner apparatus 10 further comprises an airflow delivery system 18 including an elongated carrier pipe 20 extending in a lengthwise direction of trailer 12 and respective left and right elongated manifolds 22 and 24 pivotally mounted to a rear end of carrier pipe 20. In the illustration of FIG. 1, carrier pipe 20 is shown in its rearward extended position relative to trailer 12, and manifolds 22 and 24 are shown in their usage position extending laterally outward from carrier pipe 20. In this configuration, apparatus 10 is operable to discharge air along an air curtain axis defined by a plurality of nozzles 90 (FIG. 5) aligned along the length of manifolds 22 and 24 to create an air curtain over a combustion trench and provide continued air flow through the trench.

Figure 2:
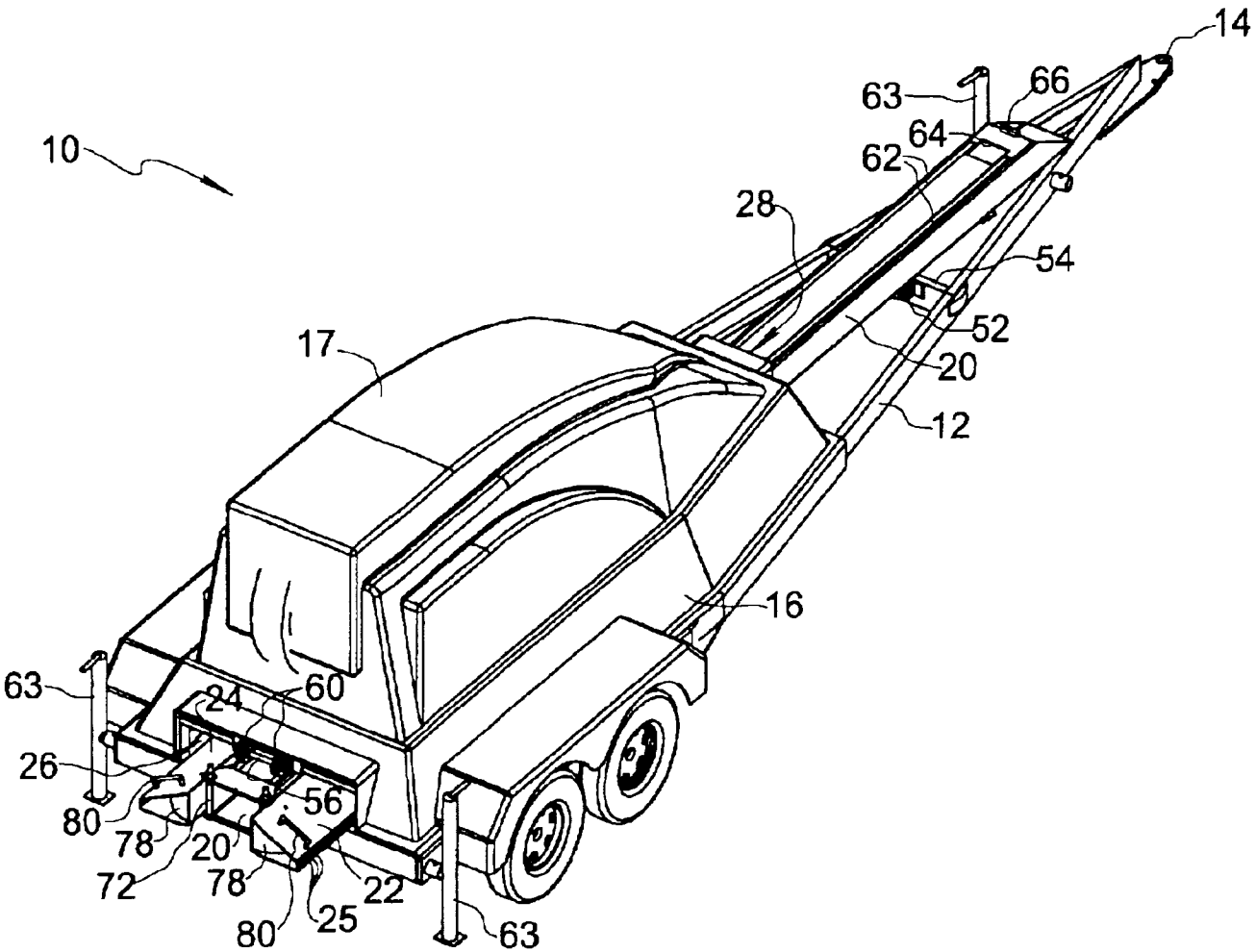
FIG. 2 is a perspective view of the trench burner apparatus shown in FIG. 1, shown ready for transport or storage.

FIG. 2 shows trench burner apparatus 10 in a transport and storage condition. More specifically, left and right manifolds 22 and 24 have been folded relative to carrier pipe 20 so as to extend alongside the carrier pipe in close adjacency thereto, and the carrier pipe has been moved forward relative to trailer 12 into a retracted position such that the carrier pipe extends through lower enclosure 16 and manifolds 22 and 24 are received at least partially within the lower enclosure. Lower enclosure 16 includes a rear opening 26 and a front opening 28 through which carrier pipe 20 passes. Rear opening 26 is sized to accommodate left and right manifolds 22 and 24 in addition to carrier pipe 20.

Figure 3:
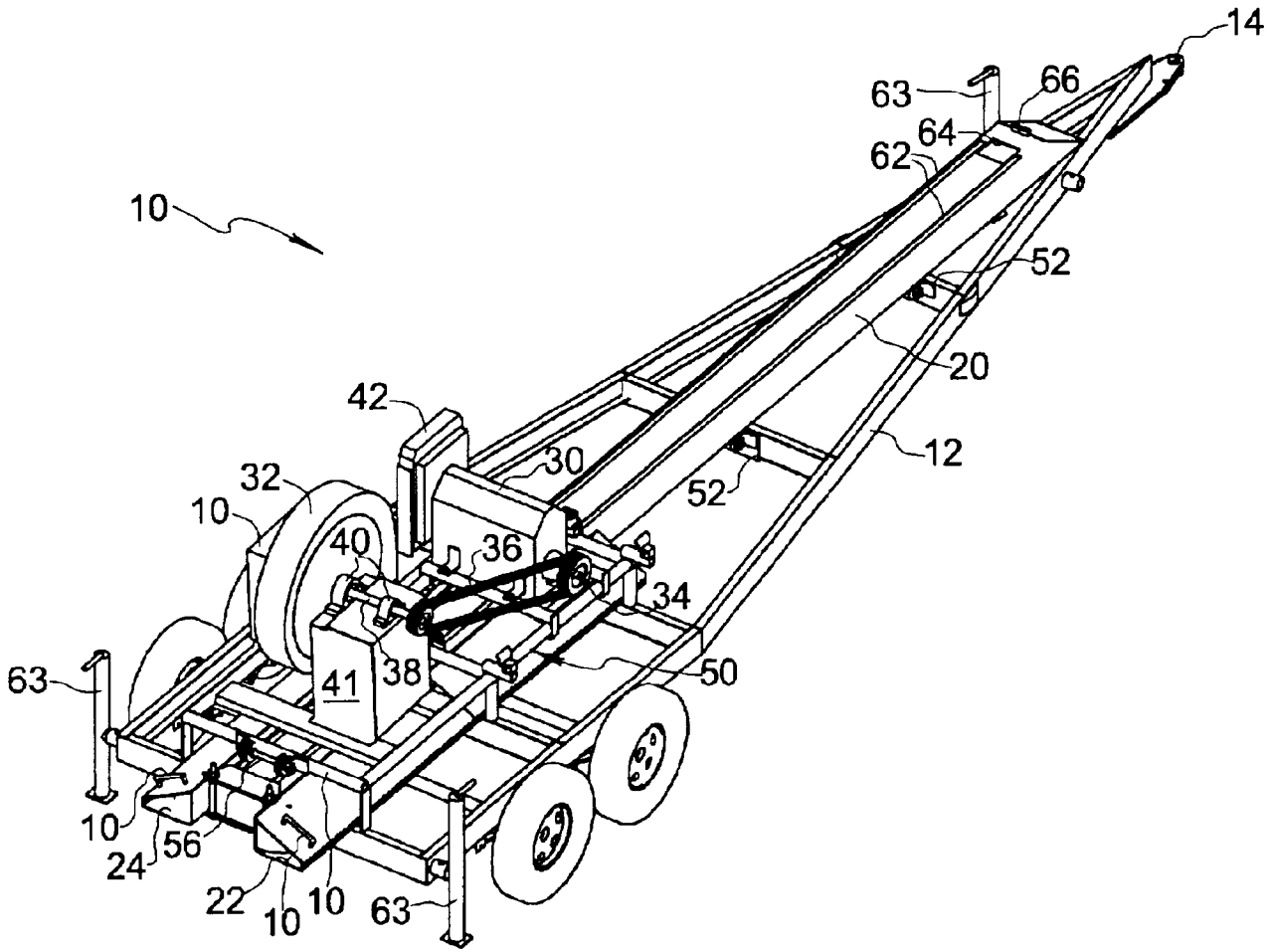
FIG. 3 is a perspective view similar to that of FIG. 2, however a canopy and lower enclosure of the trench burner apparatus have been removed to show internal components thereof.

FIG. 3 shows trench burner apparatus 10 with lower enclosure 16 and canopy 17 removed to reveal internal equipment and machinery for generating a high-velocity airflow. Apparatus 10 includes an engine 30 for powering a radial fan 32. By way of example, in the preferred embodiment described herein, engine 30 is a four-cylinder diesel engine such as a Perkins Industrial 400 Series engine rated at min. 40 HP (30 kW). Engine 30 rotates a drive shaft 34 directly coupled by V-belts 36 to a fan shaft 38 rotatably supported by bearings 40 mounted on top of a storage bin 41, whereby fan 32 rotates to provide up to 12,000 CFM (340 $m^3$/min) of air flow. An instrument panel 42 is provided for controlling and monitoring engine 30.

Figure 4:
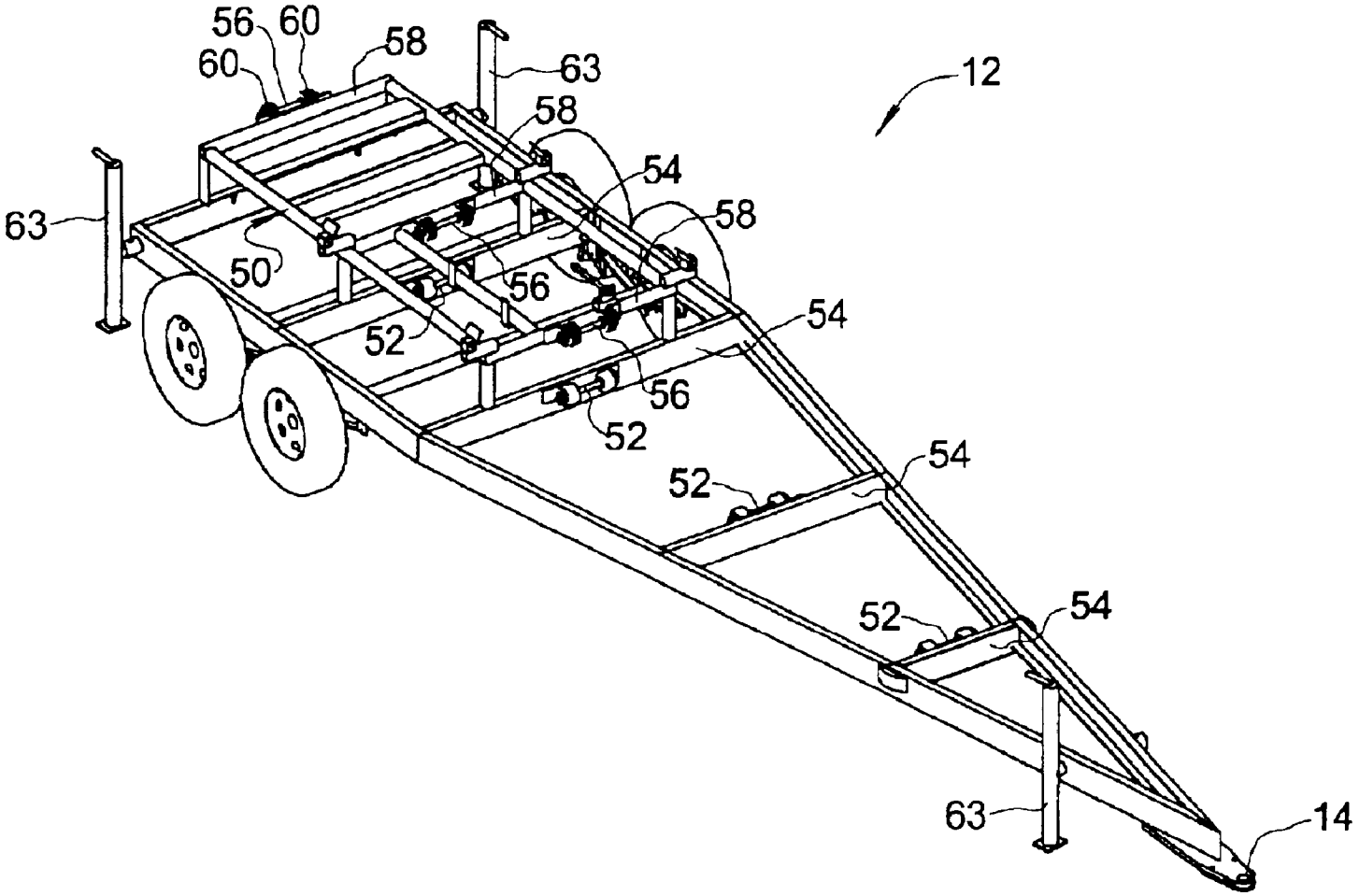
FIG. 4 is a perspective view of a trailer of the trench burner apparatus shown in FIGS. 1–3.

As best seen in FIG. 4, trailer 12 includes an equipment frame 50 housed within lower enclosure 16 beneath canopy 17 for supporting the internal equipment and airflow machinery described in the previous paragraph, and for providing space for receiving carrier pipe 20, left manifold 22, and right manifold 24. Trailer 12 is depicted as including a plurality of support wheel assemblies 52 mounted on transversely extending cross-beams 54 for engaging an underside of carrier pipe 20 to facilitate adjustment of carrier pipe 20 between its extended and retracted positions. Trailer 12 further includes a plurality of guide wheel assemblies 56 mounted on cross members 58 of equipment frame 50. Each guide wheel assembly 56 has a pair of grooved guide wheels 60 for receiving corresponding longitudinal rails 62 (FIG. 5) formed on a top side of carrier pipe 20 to keep the carrier pipe in proper alignment as it is moved between its extended and retracted positions. Three jacks 63 are located at opposite rear corners and near a front end of the trailer, respectively, for leveling and stabilizing the trailer at a combustion trench location.

Figure 5:
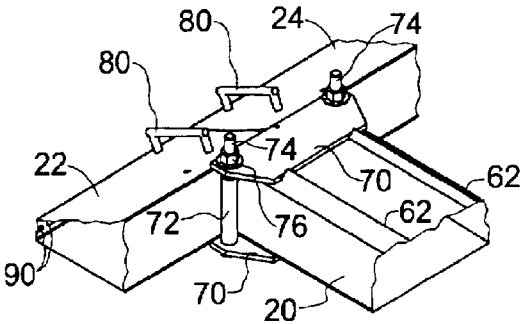
FIG. 5 is an enlarged detail view of structure generally enclosed by circle A in FIG. 1.

Referring also to FIG. 5, carrier pipe 20 is preferably constructed of welded steel that is one-quarter inch (6.4 mm) in thickness. Carrier pipe 20 includes an entrance port 64 through the top side thereof near a front end of the carrier pipe. When carrier pipe 20 is in its rearward extended position, entrance port 64 is located adjacent to fan 32 such that airflow generated by fan 32 enters carrier pipe 20 through entrance port 64 and is guided by the carrier pipe. The front end of carrier pipe 20 is preferably angled to accommodate a flow deflector (not shown) for redirecting airflow entering through entrance port 64 to a rearward flow direction along carrier pipe 20. Carrier pipe 20 further includes an upwardly protruding catch tab 66 near its front end for engaging a metal stop (not shown) on a cross-member 58 of equipment frame 50. A pair of manifold rests 68, only one being visible in FIG. 1, extend laterally from left and right sides of carrier pipe 20 near a mid-region thereof for helping to support manifolds 22 and 24 when the manifolds are pivoted to their storage position extending alongside carrier pipe 20. It is contemplated to provide a containment bracket (not shown) fixed near the front end of trailer 12 for receiving the front end of retracted carrier pipe 12 and providing structure to which the carrier pipe can be secured when trench burner apparatus 10 is towed.

A pair of hinge plates 70, one upper and one lower, are respectively fixed to the top side and underside of carrier pipe 20 at the rear end of the carrier pipe for use in pivotally mounting left and right manifolds 22 and 24 to the carrier pipe. Hinge plates 70 extend beyond the left and right sides of carrier pipe 20 and include axially aligned through-holes associated with the left and right sides for defining hinge axes about which left and right manifolds 22 and 24 pivot or fold. Manifolds 22 and 24 include respective hinge sleeves 72 and fixed near a proximal end of each manifold through. Pivotal mounting is accomplished by hinge pins 74 extending through sleeves 72 and the aligned holes in hinge plates 70. Each hinge pin 74 is secured by a mating nut 76.

Figure 6:
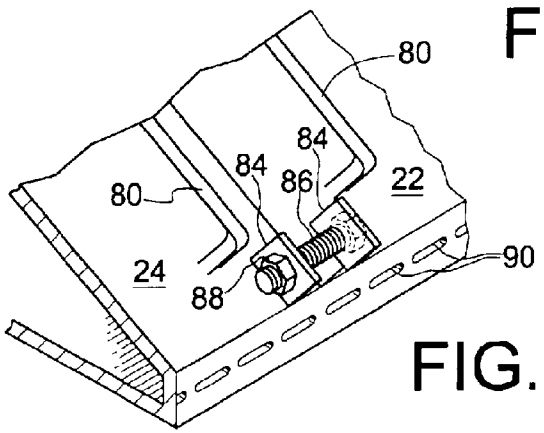
FIG. 6 is another enlarged detail view showing a releasable locking means for securing left and right manifolds of the present invention in end-to-end abutment.

Similar to carrier pipe 20, left and right manifolds 22 and 24 are preferably constructed of welded steel that is one-quarter inch (6.4 mm) in thickness. A flow deflector 78 is provided within each manifold at the proximal end of the manifold for receiving airflow from carrier pipe 20 and redirecting the airflow along the manifold from toward a distal end of the manifold. Manifolds 22 and 24 each preferably include a first handle 80 fixed near the manifold's proximal end for use in pushing and pulling the airflow delivery system 18 lengthwise relative to trailer 12 and a second handle 82 fixed near the manifold's distal end for use in pivoting the manifold relative to carrier pipe 20. When manifolds 22 and 24 are in their usage position as depicted in FIG. 1, their respective proximal ends are in end-to-end abutment and are preferably secured in this position by a releasable locking means. In the current embodiment, left and right manifolds 22 and 24 include a pair of brackets 84 fixed one at the proximal end of the left manifold and one at the proximal end of the right manifold, and brackets 84 have axially aligned holes for receiving a locking means. For example, in the embodiment shown in FIG. 6, the locking means comprises a bolt 86 extending through the holes in brackets 84, a nut 88 mating with bolt 86. A security pin (not shown) can be fed through a diametrically extending hole through the tip of bolt 86 to ensure that nut 88 remains in place. Preferably, bolt 86, nut 88, and the security pin are also used to secure carrier pipe 20 to a containment bracket (not shown) at the front of trailer 12 to prevent the carrier pipe from rolling out to its extended position during towing. Left and right manifolds 22 and 24 further include a plurality of output nozzles 90 for discharging air. Nozzles 90 are preferably formed in accordance with the teachings of commonly owned U.S. Pat. No. 5,415,113 mentioned above, which patent is incorporated herein by reference.

Preferred methods of setting up an incineration trench 8 and trench burner apparatus 10 for incineration of waste, and for removal of trench burner apparatus 10 from an operating location at an incineration trench, will now be described. Trench burner apparatus 10 is transported by towing it behind a vehicle (not shown) to the the region of a desired trench location. When towed, trench burner apparatus is in a compact state as shown in FIG. 2. Once trench burner apparatus 10 is in place, canopy 17 is lifted open and jacks 63 are removed from storage bin 41. The jacks 63 are fitted to jack points of trailer 12 and the trailer is unhitched and disconnected from the towing vehicle, which is moved away from the area. After the internal electrical and mechanical systems have been prepared and checked, canopy 17 is closed and the jacks are used to set the trailer level. Next, airflow delivery system 18 is arranged in flow communication with radial fan 32 by removing the hardware (for example bolt 86 and nut 88) used to secure carrier pipe 20 to a containment bracket or other fixing structure on trailer 12, and pulling on grab handles 80 at the proximal ends of manifolds 22 and 24 to roll the carrier pipe and manifolds rearward in a longitudinal direction of the carrier pipe until catch tab 66 engages with the provided metal stop (not shown), thereby positioning entrance port 64 of carrier pipe 20 directly beneath an outlet of radial fan 32. In a preferred embodiment, markings will be provided, one fixed on carrier pipe 20 and another fixed relative to trailer 12 to permit confirmation that entrance port 64 is properly aligned with fan 32. Airflow delivery system 18 is then unfolded by pivoting left and right manifolds 22 and 24 outward from carrier pipe 20 to their usage position shown in FIG. 1. More specifically, the grab handle 82 at the distal end of each manifold is used for lifting the manifold slightly so as to unseat the manifold from its corresponding manifold rest 68 and pivoting the manifold into position. Left and right manifolds 20 are then secured end-to-end in their usage position, for example by installing the locking hardware described above in connection with FIG. 6. As will be appreciated, when manifolds 22 and 24 are unfolded from carrier pipe 20 to their usage position, nozzles 90 are in alignment and serve to define an air curtain axis along which an air curtain is generated by apparatus 10. At this stage, incineration trench 8 is dug in a known manner in edgewise adjacency to the air curtain axis as shown in FIG. 1.

Like the set up procedure described above, removal of trench burner apparatus 10 from its operating location at incineration trench 8 is a relatively simple matter. After bolt 86 and nut 88 are uncoupled and removed from brackets 84 to unlock manifolds 22 and 24, airflow delivery system 18 is folded by pivoting each manifold inward toward carrier pipe 20 using handle 82 until each manifold is seated in its corresponding manifold rest 68. Airflow delivery system 18 is then moved out of flow communication with fan 32 by grasping handles 80 and pushing manifolds 22, 24 together with carrier pipe 20 forward in a longitudinal direction of the carrier pipe until airflow delivery system 18 is fully retracted onto trailer 12 as illustrated in FIG. 2. Once carrier pipe is secured on trailer 12, the trailer is connected to a towing vehicle and trench burner apparatus 10 is towed away from the incineration site.

What is claimed is:

1. A trench burner apparatus comprising:

a trailer;

a blower source supported by said trailer for providing airflow;

an elongated carrier pipe extending in a lengthwise direction of said trailer, said carrier pipe being mounted on said trailer for movement relative to said trailer between a forward retracted position and a rearward extended position wherein said carrier pipe is in flow communication with said blower source; and at least one elongated manifold pivotally mounted to said carrier pipe for folding movement relative to said carrier pipe between a storage position wherein said manifold extends alongside said carrier pipe and a usage position wherein said manifold extends in a lateral direction from said carrier pipe and is in flow communication with said carrier pipe, said manifold including a plurality of output nozzles spaced therealong for discharging air.

2. The trench burner apparatus according to claim 1, wherein said at least one manifold extends perpendicular to said carrier pipe when said at least one manifold is in said usage position.

3. The trench burner apparatus according to claim 1, wherein said at least one manifold comprises a left manifold and a right manifold associated with opposite lateral sides of said carrier pipe.

4. The trench burner apparatus according to claim 3, wherein each of said left and right manifolds includes a proximal end near a location of pivotal mounting of said manifold to said carrier pipe, a distal end opposite said proximal end, and a flow deflector at said proximal end for receiving air flow from said carrier pipe and redirecting said air flow along said manifold when said manifold is in said usage position.

5. The trench burner apparatus according to claim 4, wherein each of said left and right manifolds includes a handle at said proximal end thereof and a handle at said distal end thereof.

6. The trench burner apparatus according to claim 4, further comprising means for locking said left and right manifolds in said usage position.

7. The trench burner apparatus according to claim 6, wherein said left and right manifolds include a pair of brackets fixed one at said proximal end of said left manifold and one at said proximal end of said right manifold, each said bracket has a hole therethrough, said holes are in axial alignment with one another when said left and right manifolds are in said usage position, and said means for locking said left and right manifolds extends through said holes.

8. The trench burner apparatus according to claim 7, wherein said means for locking said left and right manifolds comprises a locking bolt and a nut mating with said locking bolt.

9. The trench burner apparatus according to claim 1, wherein said at least one manifold includes a tubular hinge sleeve fixed thereto, said carrier pipe includes upper and lower hinge plates fixed at said rear end thereof, each said hinge plate having a hinge plate hole therethrough, said hinge sleeve being arranged between said hinge plates and in axial alignment with said hinge plate holes, and said at least one manifold is pivotally mounted by a hinge pin extending through said hinge plate holes and said hinge sleeve.

10. The trench burner apparatus according to claim 1, wherein said carrier pipe includes an entrance port arranged adjacent to said blower source when said carrier pipe is in said rearward extended position.

11. The trench burner apparatus according to claim 1, wherein said entrance port opens in an upwardly facing direction through said carrier pipe, and said entrance port is positioned beneath said blower source when said carrier pipe is in said rearward extended position.

12. The trench burner apparatus according to claim 1, wherein said trailer includes a plurality of support roller assemblies spaced from each other in said lengthwise direction for facilitating movement of said carrier pipe between said retracted and extended positions.

13. The trench burner apparatus according to claim 1, wherein said trailer includes an equipment frame to which said blower source is fixed, and a canopy covering said blower source and equipment frame.

14. The trench burner apparatus according to claim 13, wherein said trailer further includes a lower enclosure about said equipment frame, and said canopy is hingedly connected to said lower enclosure.

* * * * *